US008893390B2

(12) United States Patent
Nie et al.

(10) Patent No.: US 8,893,390 B2
(45) Date of Patent: Nov. 25, 2014

(54) POWER TOOL WITH REPLACEABLE BLADE

(75) Inventors: Fangjie Nie, Nanjing (CN); Qi Zhang, Nanjing (CN); Pingbo Shi, Nanjing (CN)

(73) Assignee: Chervon (HK) Limited, Hong Kong (HK)

( * ) Notice: Subject to any disclaimer, the term of this patent is extended or adjusted under 35 U.S.C. 154(b) by 309 days.

(21) Appl. No.: 13/596,681

(22) Filed: Aug. 28, 2012

(65) Prior Publication Data

US 2013/0055574 A1 Mar. 7, 2013

(30) Foreign Application Priority Data

Sep. 6, 2011 (CN) ..... 2011 1 0261714

(51) Int. Cl.
*B26B 13/04* (2006.01)

(52) U.S. Cl.
USPC ..... 30/247; 30/270

(58) Field of Classification Search
USPC ..... 30/270, 247, 245, 234, 228, 275, 216, 30/92, 93, 97
See application file for complete search history.

(56) References Cited

U.S. PATENT DOCUMENTS

| | | | | |
|---|---|---|---|---|
| 6,141,878 | A * | 11/2000 | Eslambolchi et al. | 30/216 |
| 7,407,015 | B2 * | 8/2008 | Stones | 173/170 |
| 7,937,838 | B2 * | 5/2011 | Patton et al. | 30/134 |
| 7,958,642 | B2 * | 6/2011 | Rosskamp | 30/392 |
| 8,539,678 | B2 * | 9/2013 | Dahlberg et al. | 30/199 |
| 2005/0081387 | A1 * | 4/2005 | Sun et al. | 30/228 |
| 2005/0160606 | A1 * | 7/2005 | Yao | 30/228 |
| 2008/0263872 | A1 * | 10/2008 | Ferk et al. | 30/228 |
| 2008/0301948 | A1 * | 12/2008 | Kostner et al. | 30/42 |
| 2009/0241351 | A1 * | 10/2009 | Maniwa et al. | 30/228 |
| 2009/0271991 | A1 * | 11/2009 | Clark et al. | 30/228 |
| 2010/0031514 | A1 * | 2/2010 | Kohn | 30/216 |
| 2010/0077621 | A1 * | 4/2010 | Quigley et al. | 30/228 |
| 2012/0246942 | A1 * | 10/2012 | Nie et al. | 30/247 |
| 2013/0160304 | A1 * | 6/2013 | Tate | 30/381 |
| 2014/0165411 | A1 * | 6/2014 | Binder | 30/228 |

* cited by examiner

*Primary Examiner* — Sean Michalski
(74) *Attorney, Agent, or Firm* — Greenberg Traurig, LLP

(57) ABSTRACT

A power tool includes a replaceable blade, a fixing device for clamping and securing the blade, a control circuit for controlling a driving device, and a main switch electrically connected to the control circuit. A safety device prevents the blade from moving when the fixing device is opened.

20 Claims, 13 Drawing Sheets

B–B

C-C

E-E

POWER TOOL WITH REPLACEABLE BLADE

RELATED APPLICATION INFORMATION

This application claims the benefit of CN 201110261714.4, filed on Sep. 6, 2011, the disclosure of which is incorporated herein by reference in its entirety.

BACKGROUND

The following generally relates to power tools, and more particular, to a power tool with a replaceable blade.

For a power tool having a blade which is easily worn, it is needed to change the blade frequently during use. In some power tools, the blade is fastened to the power tool by a screw, so the blade can be removed by releasing the screw when replacing the blade. In other power tools, the blade is fastened to the power tool by a quick-clamping device, thus the blade can be removed after an operating lever of the quick-clamping device is rotated a certain angle. However, when the blade is being replaced, the power tool can be unduly activated. There is no device to prevent the power tool from being incorrectly activated, which is unsafe for the user to replace the blade.

SUMMARY

The technical problem to be solved by the present invention is to provide a power tool with a replaceable blade so as to prevent the power tool from being activated during the blade is replaced, and can ensure the user to replace the blade safely.

In order to solve the above technical problem, the present invention provides a power tool including a motor; a transmission mechanism; a fixed blade and a movable blade driven by the motor which is replaceable; a quick-locking device manually operable by a user being arranged for locking the movable blade, the quick-locking device comprising a quick-locking spanner which is switchable between a locking position where the movable blade is locked to stay connected with the transmission mechanism and a release position where the movable blade is released to be detachable from the transmission mechanism; a control circuit for controlling the motor; a main switch for powering on/off the motor, which is electrically connected to the control circuit; and a safety device for leading the control circuit conducted or nonconducted in cooperate with the main switch, if the quick-locking spanner is in the release state, the control circuit is nonconducted result from the safety device, so that the movable blade is prevented from moving, if the quick-locking spanner is in the locking state, the control circuit is conducted when the main switch is turned on.

In order to solve the above technical problem, the present invention also provides a power tool including a motor, a replaceable blade driven by the motor; a fixing device for clamping and securing the blade which comprises a locking state wherein the blade is clamped and a release state wherein the blade can be replaced, a control circuit for controlling the motor, a main switch for powering on/off the motor which is electrically connected to the control circuit, and a safety device for preventing the blade from moving when the fixing device is in the release state.

In the present invention, the power tool includes a safety device. By a mechanical manner or an electrical manner, the safety device prevents the main power switch of the power tool from being turned on or the control circuit is in an open state during the blade is replaced, so that the power tool cannot be activated. After the replacement for the blade is finished, the main power switch can be opened normally, or the control circuit is in a connecting state, so that the power tool can be operated normally. This can prevent the power tool from being activated during the process of replacing the blade and thus ensure the user to replace the blade safely.

DETAILED DESCRIPTION

A power tool of the present invention includes a replaceable blade, a fixing device for clamping and securing the blade, a driving device including a transmission mechanism and a motor, a control circuit for controlling the motor, and a main switch electrically connected to the control circuit. The driving device is capable of driving the blade to move. In the present invention, the main switch may be serially connected to the control circuit. The power tool also includes a safety device that can prevent the blade from moving when the fixing device is released.

Next, the power tool of the present invention will be explained in details taking an electric pruner as an example.

Figure 1:
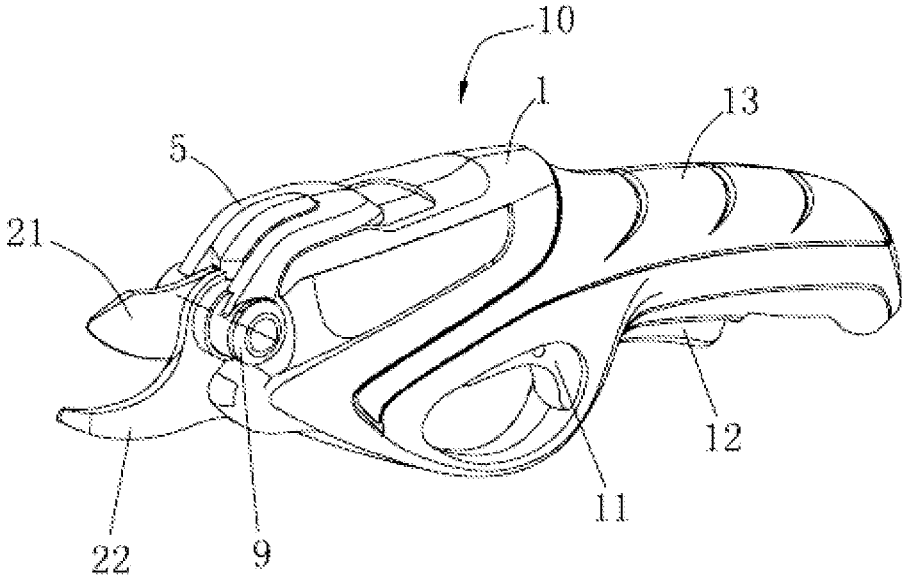
FIG. 1 is a perspective view of an example electric pruner according to the present disclosure, and the electric pruner includes a housing and a quick-locking spanner.
Figure 3:
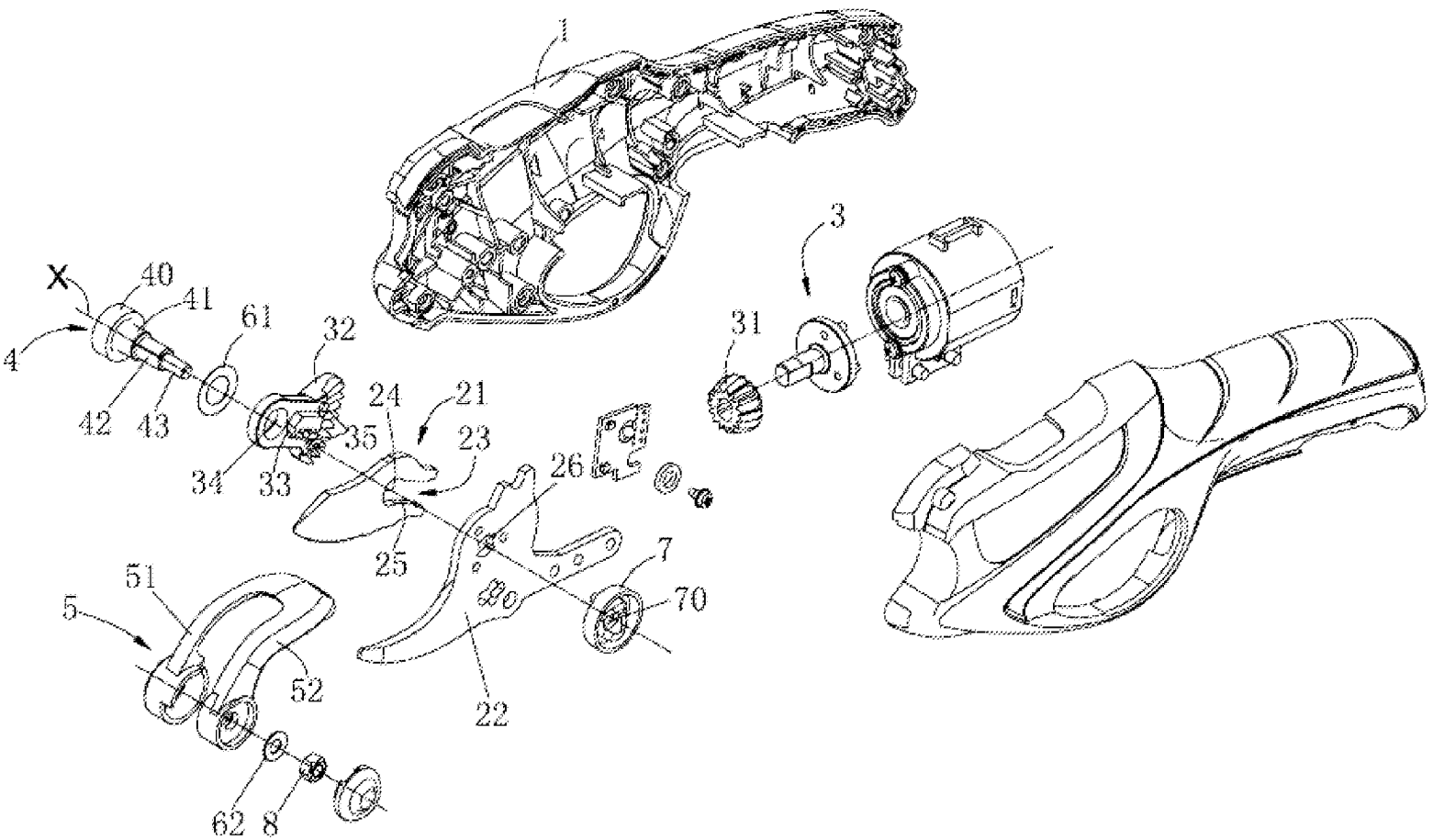
FIG. 3 is an exploded view of the example electric pruner.

Referring to FIGS. 1 and 3, the electric pruner 10 includes a housing 1, a motor 14, a transmission mechanism 3, and a built-in battery (not shown) accommodated within the housing 1. A main switch 11 and a lock-off switch 12 are mounted under the housing 1 so as to control the motor 14. A gripping portion 13 is formed by the rear portion of the housing 1. A movable blade 21 and a fixed blade 22 extend from the front end of the housing 1, wherein the fixed blade 22 is fixedly mounted in the housing 1 by a bolt or the like, and the movable blade 21 is rotatably connected to the fixed blade 22 by a shaft 4. In the present example, the shaft 4 is a bolt.

Figure 2:
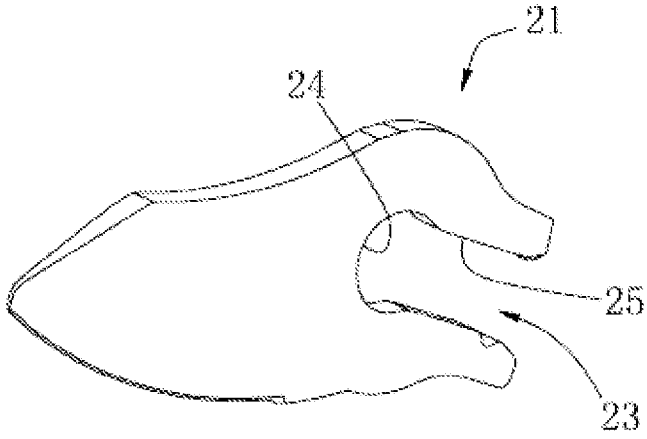
FIG. 2 is an enlarged view of a movable blade of the electric pruner.

Also referring to FIG. 2, the movable blade 21 is provided with a groove 23 which includes a first groove portion 24 and a second groove portion 25 communicating with the first groove portion 24. The first groove portion 24 is substantially circular-shaped and the second groove portion 25 is elongated, wherein the circular-shaped groove 24 is sized larger than the elongated groove 25.

The transmission mechanism 3 includes a first bevel gear 31 and a second bevel gear 32 meshed with the first bevel gear 31. With this arrangement, when the first bevel gear 31 is driven to rotate by the motor 14, the second bevel gear 32 swings back and forth. The second bevel gear 32 is provided thereon with a boss 33 engaging with the second groove portion 25 of the movable blade 21 and a pair of stop elements 35 for abutting against one end surface of the movable blade 21 for defining the position of the movable blade 21. The movable blade 21 is then driven by the second bevel gear 32 to swing back and forth to perform a cutting motion.

The installation of the movable blade 21 and the fixing device will be described next. The fixing device is a quick-locking device. The quick-locking device can be directly operated by the user so as to be switched between a locking position and a release position. "Directly operated" as mentioned herein indicates that the quick-locking device is manually operated directly by the user without requiring any other auxiliary tools.

Figure 4:
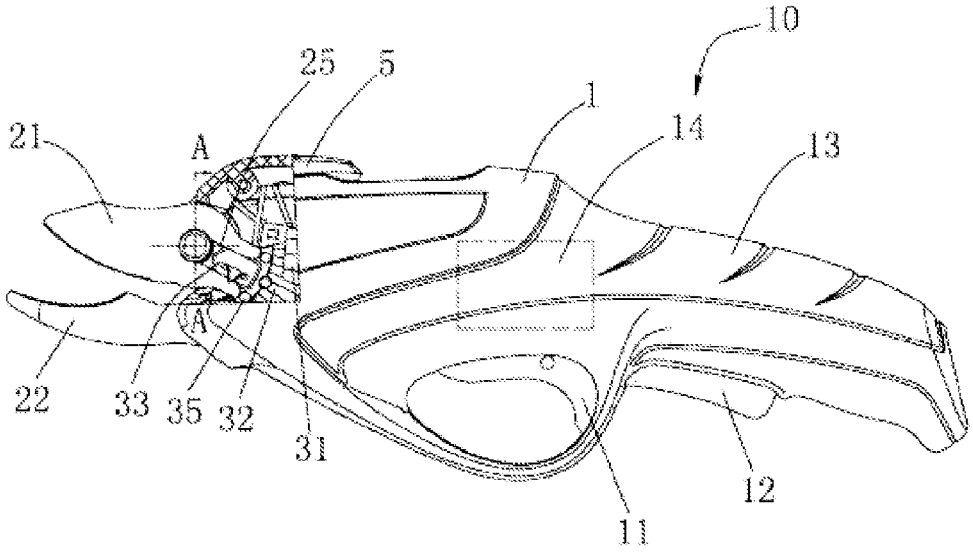
FIG. 4 is a plan view of the electric pruner, wherein a portion of the housing is removed and the quick-locking spanner is in a locked position.
Figure 5:
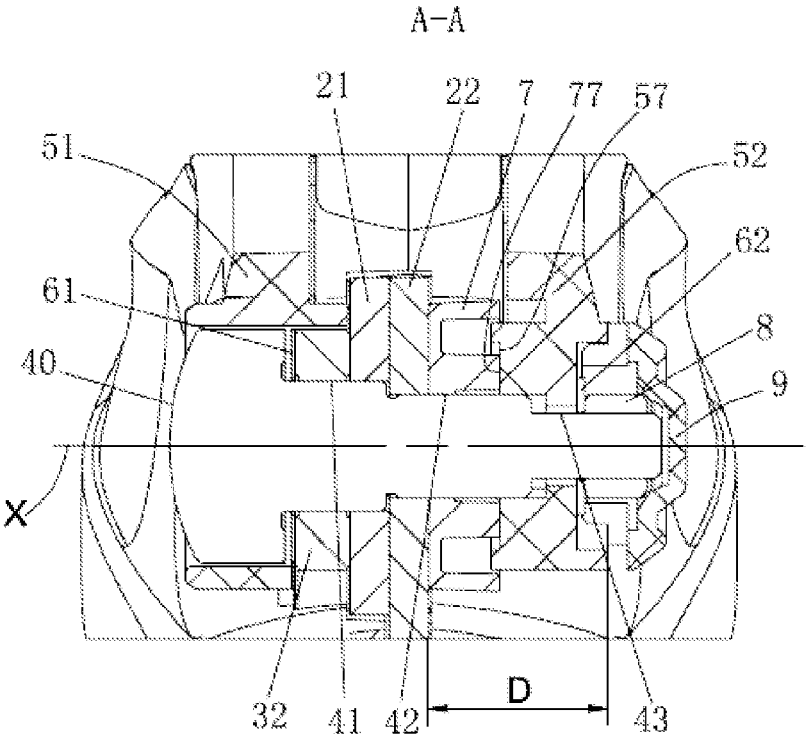
FIG. 5 is a sectional view taken along line A-A in FIG. 4.

Referring to FIGS. 3 through 5, the bolt 4 is passed through, a first arm 51 of a quick-locking spanner 5, a spring washer 61, a hole 34 on the second bevel gear 32, the circular groove 24 of the movable blade 21, a square hole 26 on the fixed blade 22, a hole 70 on the flange 7, a second arm 52 of the quick-locking spanner 5 and a washer 62. The bolt 4 is step-shaped and includes a head 40, a first mating portion 41, a second mating portion 42, and a third mating portion 43. Moreover, from the first mating portion 41 to the third mating portion 43, the diameter of the bolt 4 gradually decreases, wherein the second mating portion 42 is flat and mated with the square hole 26 on the fixed blade 22 and the square hole 70 of the flange 7. As a result, the fixed blade 22 and the flange 7 cannot be rotated relative to the bolt 4. The third mating portion 43 is provided with threads for engaging with a lock nut 8. A nut cap 9 is mounted on the second arm 52 of the quick-locking spanner 5 for covering the lock nut 8.

The quick-locking device of the movable blade 21 includes a first engaging element 5 and a second engaging element 7 engaged with the first engaging element, wherein the first engaging element 5 is an operation member directly operated by the user which is embodied as a quick-locking spanner, and the second engaging element 7 is embodied as a flange. The quick-locking spanner 5 can be rotated between the locked position and the released position relative to the flange 7.

Figure 6:
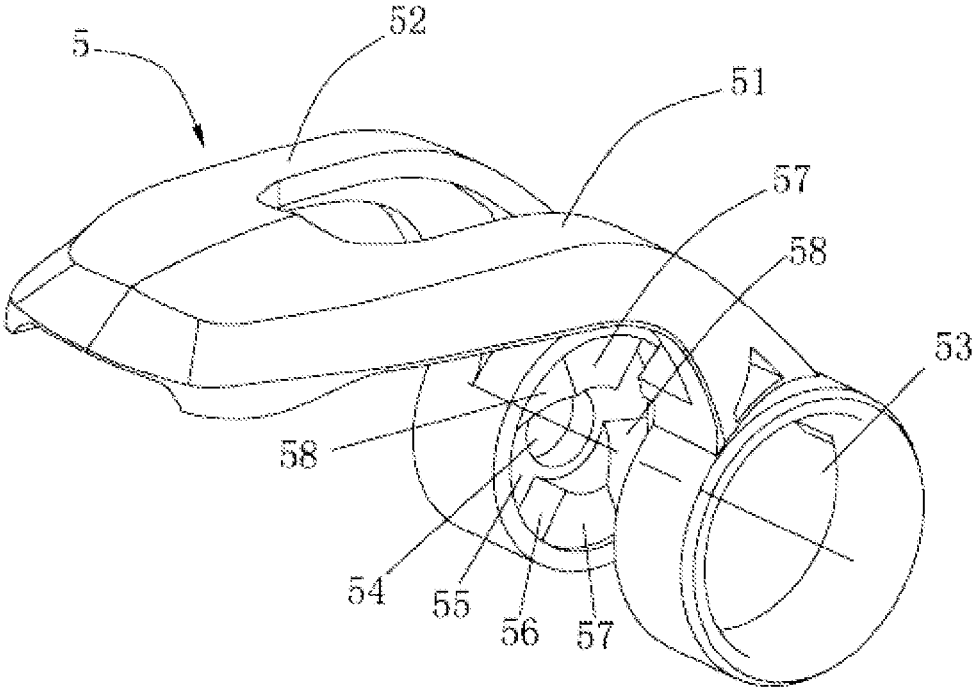
FIG. 6 is an enlarged view of the quick-locking spanner.

As shown in FIG. 6, the operation element, namely the quick-locking spanner 5, includes at least one first end surface boss 56 having an inclined plane, and accordingly, the flange 7 mounted on the shaft 4 includes at least one second end surface boss 76 having an inclined plane, wherein the first end surface boss 56 and the second end surface boss 76 are meshed with each other.

Figure 7:
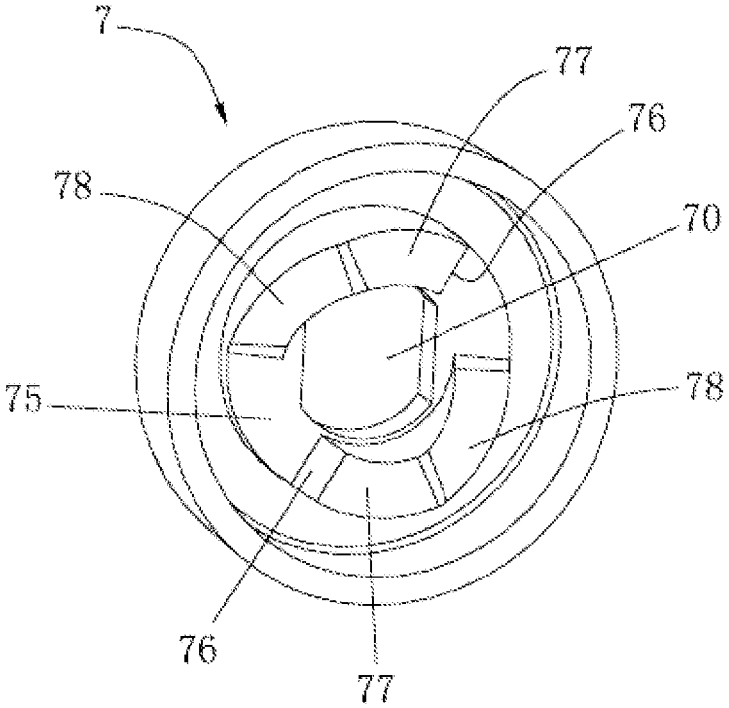
FIG. 7 is an enlarged view of a flange.

Specifically, in the present example, the quick-locking spanner 5 is substantially U-shaped, which includes the first arm 51 and the second arm 52. The first arm 51 is provided at its free end with a first cylindrical hole 53 engaging with the head 40 of the bolt 4. The second arm 52 is provided on its free end with a second cylindrical hole 54 smaller than the first cylindrical hole 53 and engaging with the third mating portion 43 of the bolt 4. A pair of first end surface bosses 56 is provided on a lowest plane 55 facing towards the first arm within the second cylindrical hole 54, each of first end surface bosses includes a highest plane 57 and an inclined plane 58 extending from the highest plane 57 to the lowest plane 55. Under the assembled state, the second arm 52 of the quick-locking spanner 5 is adjacent to the flange 7. Correspondingly, a pair of second end surface bosses 76 are provided on a lowest plane 75 facing towards the second arm 52 within the hole 70 of the flange 7, with the shape thereof being the same as that of the first end surface bosses 56, as shown in FIG. 7. Accordingly, each of the second end surface bosses also includes a highest plane 77 and an inclined plane 78 extending from the highest plane 77 to the lowest plane 75. The first end surface bosses 56 and the second end surface bosses 76 are mated with each other so as to release or lock the movable blade 21.

As shown in FIGS. 1, 4 and 5, the quick-locking spanner 5 leans on the top surface of the housing 1 in its locked position. In this state, the first mating portion 41 is engaged in the hole 34 on the second bevel gear 32 and the circular groove 24 on the movable blade 21. Moreover, the highest plane 77 of the second end surface boss 76 of the flange comes into contact with the highest plane 57 of the second end surface boss 56 of the second arm of the quick-locking spanner. At this time, the distance in the axial direction X of the bolt 4 between the flange 7 and the second arm 52 of the quick-locking spanner reaches the maximum such that the bolt 4 overcomes the elastic force of the spring washer 61 to compress the spring washer 61. As a result, the second bevel gear 32, the movable blade 21, the fixed blade 22, the flange 7 and the second arm 52 of the quick-locking spanner are arranged in a compact manner between the head 40 of the bolt 4 and the locking nut 8, and thus the movable blade 21 is locked.

Figure 9:
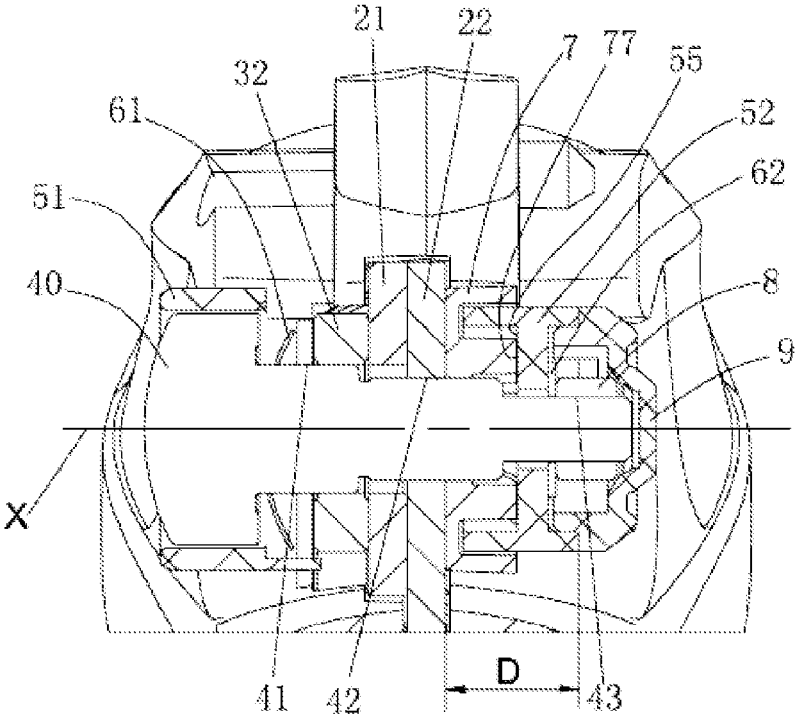
FIG. 9 is a sectional view taken along line B-B in FIG. 8.

When driven by the quick-locking spanner 5, the shaft (i.e. the bolt 4) is movable between a first position (i.e. the position as shown in FIG. 5) where the first mating portion 41 of the bolt 4 is mated with the groove 23 formed on the movable blade 21 and a second position (i.e. the position as shown in FIG. 9) where the second mating portion 42 is positioned in the groove 23.

Figure 8:
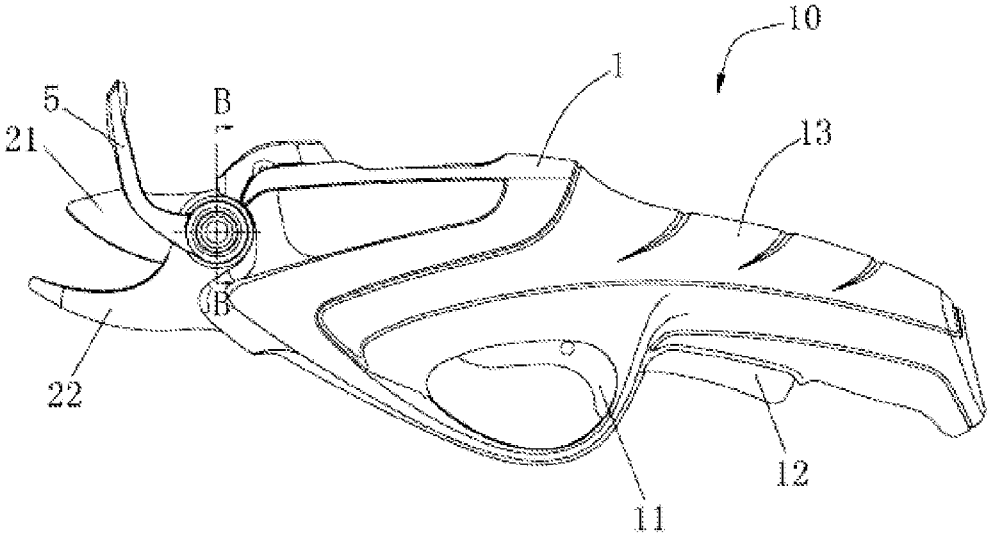
FIG. 8 is a plan view of the electric pruner, wherein the quick-locking spanner is in a released position.

As shown in FIGS. 8 and 9, the quick-locking spanner 5 is rotated away from the top surface of the housing 1 to the released position. Along with the rotation of the quick-locking spanner 5, the first end surface boss 56 is rotated relative to the second end surface boss 76, then, the highest plane 57 of the first end surface boss is rotated to the lowest plane 75 of the second end surface boss along the inclined plane 78 of the second end surface boss. As a result, the first end surface boss 56 and the second end-surface boss 76 are engaged with the other; the highest plane 57 of the first end surface boss comes into contact with the lowest plane 75 of the second end surface boss; and the lowest plane 55 of the first end surface boss comes into contact with the highest plane 77 of the second end surface boss. In this state, the axial distance D between the flange 7 and the quick-locking spanner 5 reaches the minimum. Accordingly, the spring washer 61 restores to its original shape, the elastic force of which makes the bolt 4 move to the left side of FIG. 9 such that the second mating portion 42 of the bolt moves to the circular groove 24 of the movable blade. At this time, because the outer diameter of the second mating portion 42 is smaller than the inner diameter of the circular groove 24 and slightly smaller than the width of the long-shaped groove 25, the movable blade 21 can be directly pulled out for replacement.

With the above arrangements, when the worn movable blade needs to be replaced, the user only needs to move the quick-locking spanner 5 to the released position as shown in FIG. 8 and then to pull out the movable blade 21 for replacement. When installing a new movable blade, the user inserts the new movable blade into the housing 1 first. During insertion, the groove 23 of the movable blade passes through the bolt 4 first, and then the long-shaped groove 25 slides along the two sides of the boss 33 of the second bevel gear. The movable blade 21 is installed in its suitable position until the end surface of the movable blade 21 abuts against the stop elements 35 of the second bevel gear. At this time, the user moves the quick-locking spanner 5 to enable it to rotate to lean against the top surface of the housing 1 (as shown in FIG. 1), the movable blade is then locked. During the whole course of the replacement, the replacement of the blade can be achieved without requiring the removal of any part and without requiring the help of other auxiliary tools, thus, the replacement of the blade is very simple and convenient.

In another example of the present pruner, the quick-locking device may be omitted, with the other structures remaining substantially the same. In this instance only the nut 8 is rotated to contact with the fixed blade 22. In particular, in this example, when the movable blade 21 needs to be replaced, the user can rotate the nut 8 until it is released. In this way, under the restoring force of the spring washer 61, the bolt 4 moves toward the left side of FIG. 5 such that the second mating portion 42 moves to the groove 23 of the movable blade 21. At this time, the movable blade 21 can be directly removed for replacement. Conversely, when installing the new movable blade 21, insert the movable blade 21 first into the housing 1 and then screw the nut 8 up. In this example, because the blade has a thickness (e.g., 3 mm), the nut 8 must be rotated to move a corresponding distance (e.g., 3 mm) in the axial direction when the movable blade is released. During the course of replacing the blade in this example, the user only needs to loosen or screw up the nut 8, the movable blade can be released or locked without removing any part except the nut 8. Hence, the replacement work is simple and convenient and the deficiency of dropping out the part is avoided.

In the disclosed examples, the bolt 4 is step-shaped and the first mating portion 41 thereof and the second mating portion 42 thereof are two-stage necks respectively. When replacing the blade, the bolt 4 is axially moveable between the first position and the second position, and accordingly, the first mating portion 41 or the second mating portion 42 is driven to engage with the groove 23 of the movable blade 21 such that the movable blade is locked or released. In other examples, the first mating portion and the second mating portion of the bolt 4 can be provided on the same stage of the neck. The second mating portion is flat and the first mating portion is partially cylindrical. In this way, the first mating portion has an outside dimension larger than that of the second mating portion. When replacing the blade, the bolt is rotated between the first position and the second position, to drive the first mating portion or the second mating portion to engage with the groove 23 of the movable blade such that the movable blade is locked or released.

Next, the safety device of the electric pruner will be described in detail.

As for other power tools having the replaceable blade, the technical solution of the present invention or the modifications thereof also can be utilized to safely control the replacement of the blade.

First Embodiment

Figure 10:
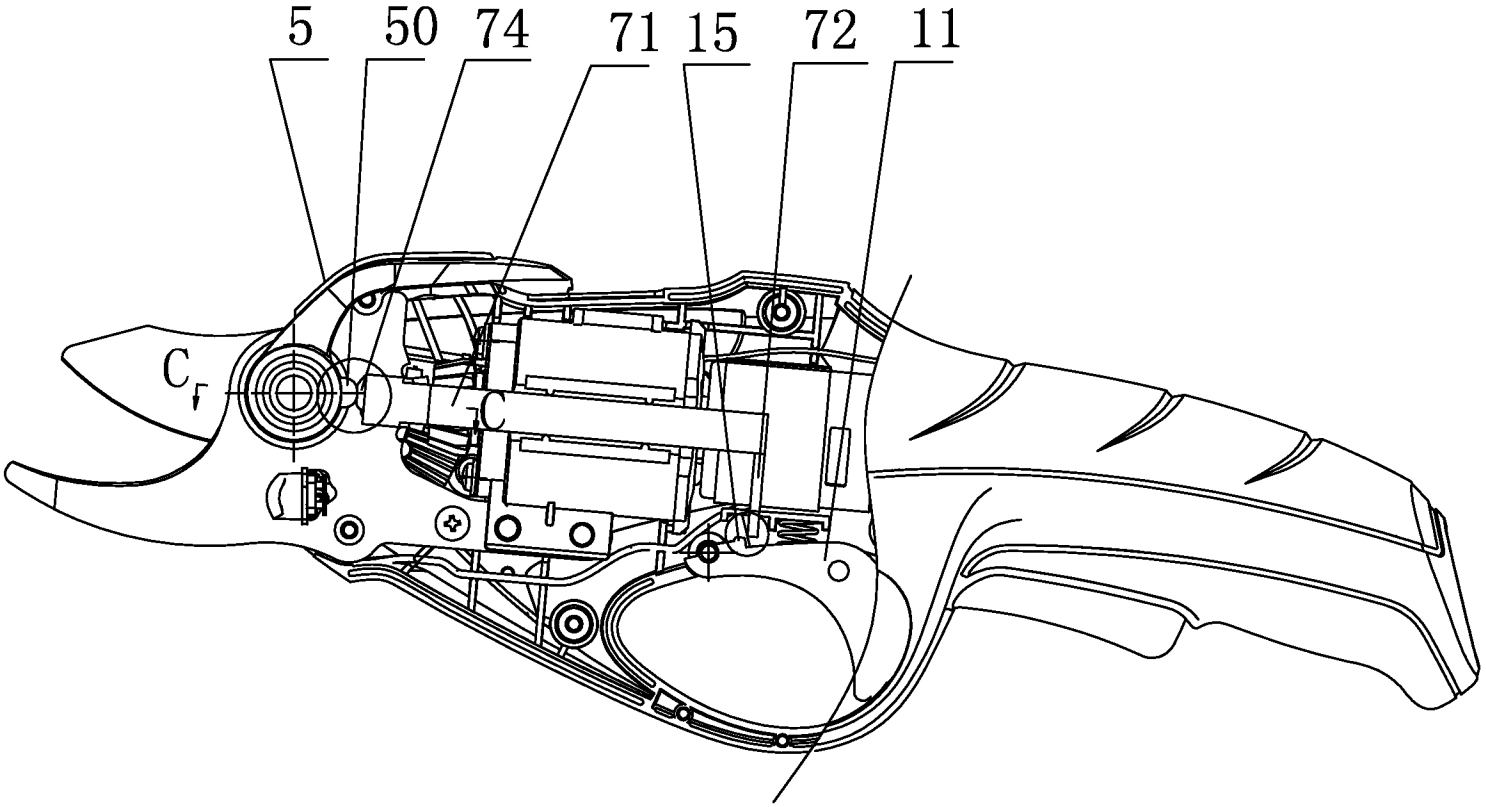
FIG. 10 is a schematic view showing a first embodiment of a power tool including a quick-clamping lever, wherein the quick-clamping lever is in a locked state.
Figure 11:
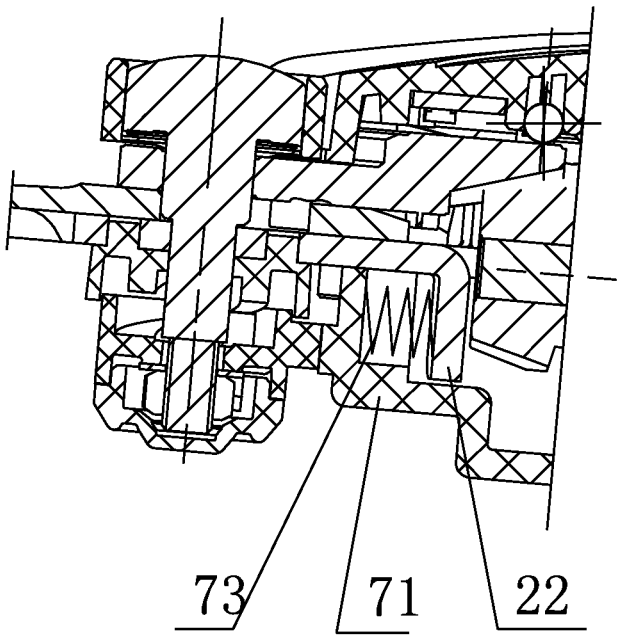
FIG. 11 is a sectional view along line C-C in FIG. 10.

Referring to FIGS. 10-11, the safety device includes mechanical components, that is, it ensures the replacement of the blade quickly and safely in a mechanical manner. A boss 50 is provided on the quick-locking spanner 5. The safety device includes a pull rod 71, an ejector rod 72, and a compression spring 73.

When the quick-locking spanner 5 is in a locking state, the boss 50 bears against a tip 74 of one end of the pull rod 71. The compression spring 73 positioned between the pull rod 71 and the fixed blade 22 is compressed. The ejector rod 72 is connected to the other end of the pull rod 71. At this time, the ejector rod 72 is deviated from a stopping protrusion 15 on the main switch 11. Thus, the stopping protrusion 15 does not contact with the ejector rod 72 and is not blocked by the ejector rod 72, such that the main switch 3 can be rotated freely to trigger a switch so as to activate the pruner. When the main switch 3 is turned on, a control circuit for controlling the motor 14 is conducted and the motor 14 is rotated to drive the movable blade 21.

Figure 12:
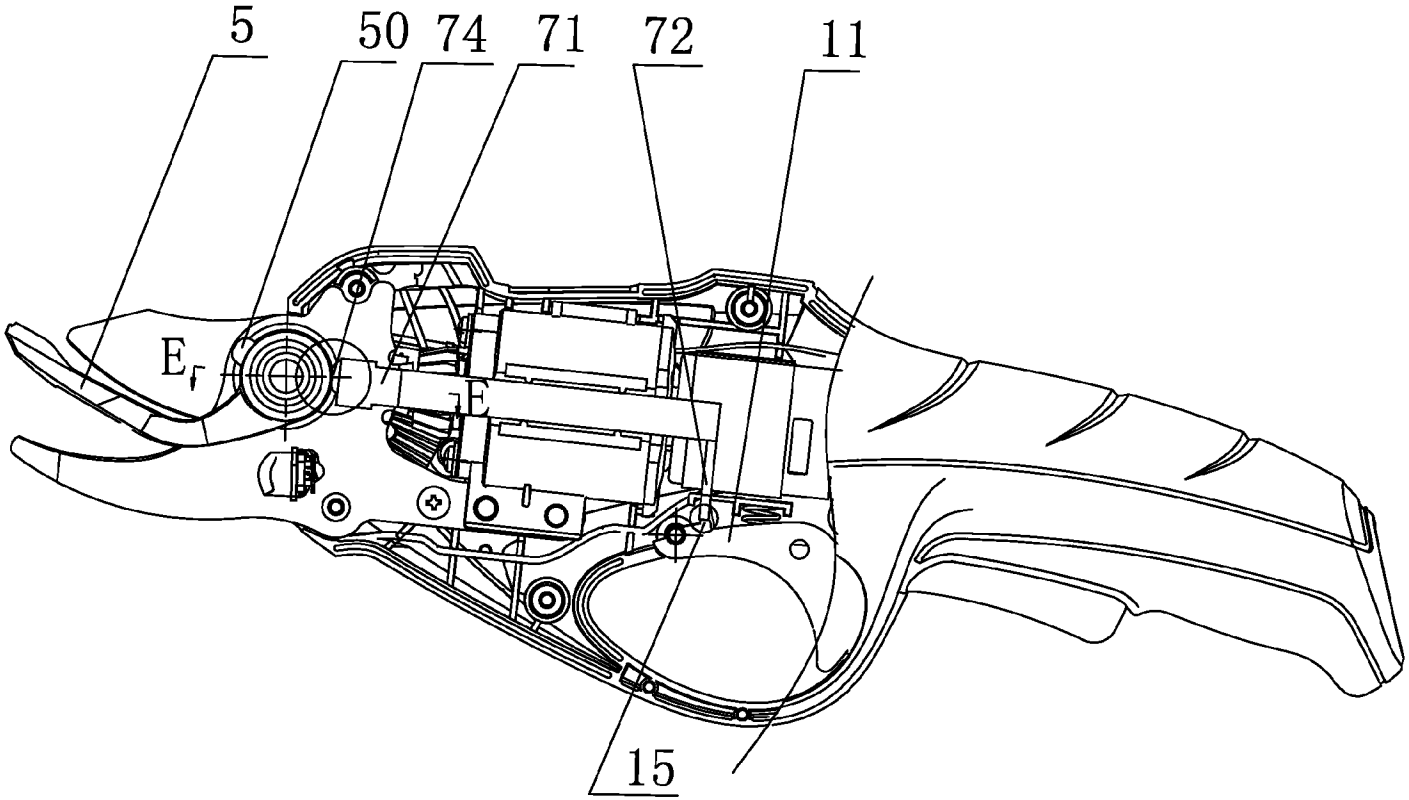
FIG. 12 is similar to FIG. 11, but the quick-clamping lever is in a released state.
Figure 13:
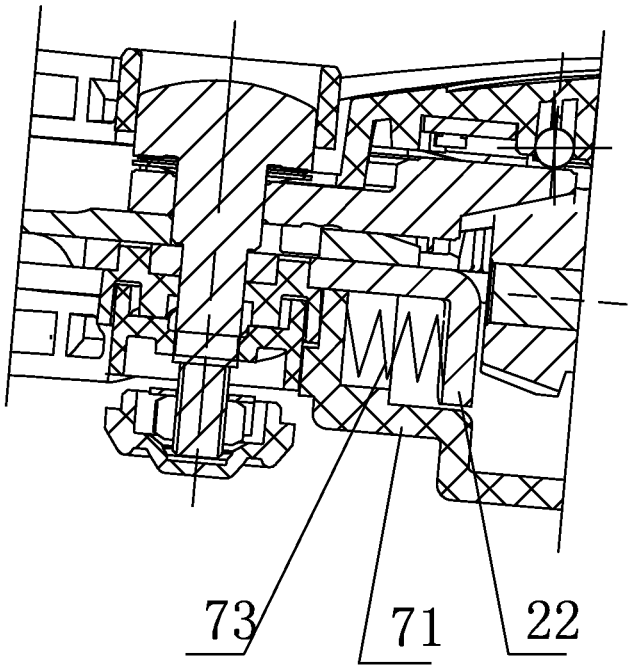
FIG. 13 is a sectional view along line E-E in FIG. 12.

Referring to FIGS. 12-13, when the quick-locking spanner 5 is operated to a release state, the boss 50 isn't contacted with the tip 74 on one end of the pull rod 71. Under the restoring force of the compression spring 73, the pull rod 71 moves forward, and the ejector rod 72 moves forward together with the pull rod 71. The ejector rod 72 moves to align with the stopping protrusion 15 on the main switch trigger. Thus, the stopping protrusion 15 contacts the ejector rod 72 and the main switch 3 is blocked by the ejector rod 72, such that the main switch 3 can't be rotated to trigger the switch. Thereby, the control circuit can't be conducted and the movement of the movable blade 21 is stopped.

Second Embodiment

Figure 14:
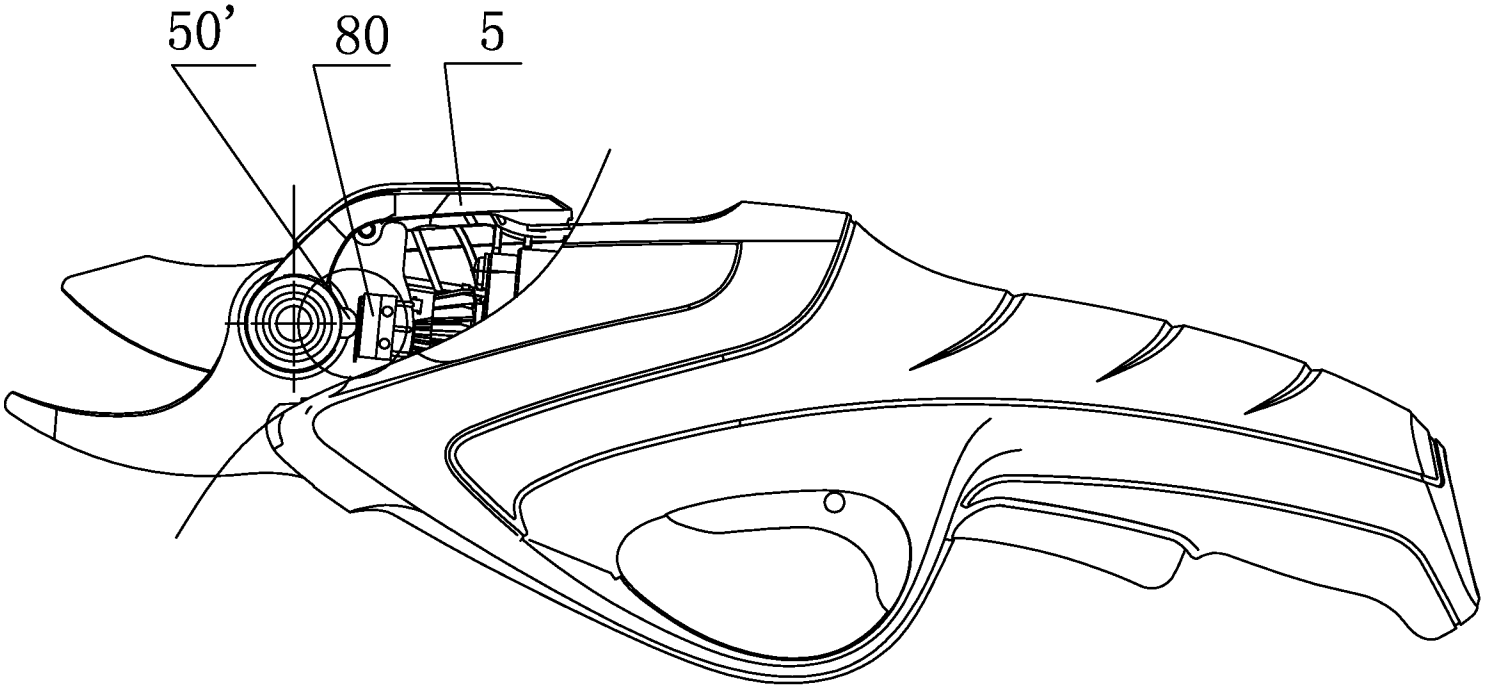
FIG. 14 is a schematic view of a second embodiment of the power tool.
Figure 15:
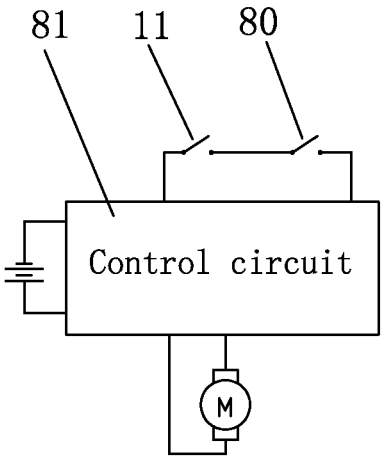
FIG. 15 is a circuit diagram of the second embodiment.
Figure 16:
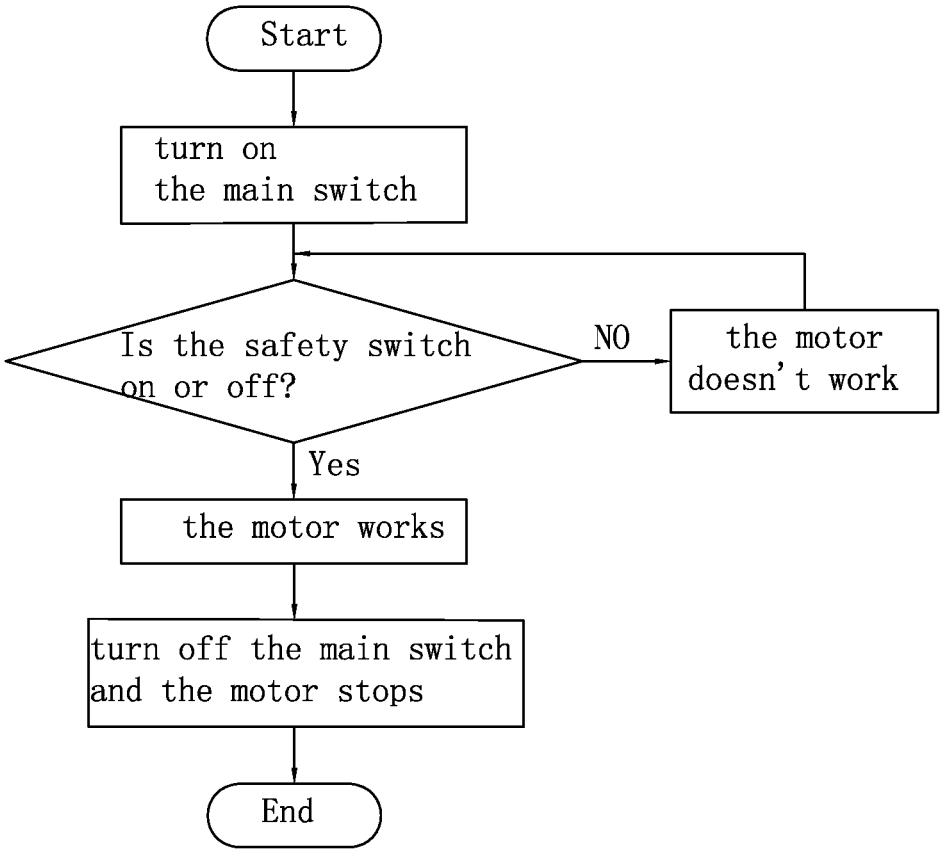
FIG. 16 is an operating flow chart of the second embodiment of the power tool.

Referring to FIGS. 14-16, the difference between the first and the second embodiment is the safety device. The safety device in the second embodiment includes mechanical components and electric components, that is, it ensures the replacement of the movable blade 21 quickly and safely in a combined manner with mechanical and electric. The safety device includes a safety switch 80 serially connected to a control circuit 81. A boss 50' that is arranged on the quick-locking spanner 5 is able to trigger the safety switch 80. A main switch 11 for power on/off the electric pruner is also serially connected to the control circuit 81.

The safety switch 80 with a mechanical contact has a switch on state and a switch off state. The safety switch 80 and the main switch 11 are serially connected to the control circuit 81. When the safety switch 80 is switched on, the main switch 11 can be trigged such that the control circuit 81 is in a conducting state. Thus the electric pruner can be operated normally. When the safety switch 80 is switched off, the circuit is in an off state. The control circuit 81 is in an off state due to the switch off of the safety switch 80 so as to prevent the movable blade 21 from moving.

Preferably, when the quick-locking spanner 5 is in the locked state, the boss 50' on the quick-locking spanner 5 bears against a button of the safety switch 80 such that the safety switch 80 is in a switch on state, thus the control circuit 81 is conducted. When the quick-locking spanner 5 is released, the boss 50' is rotated together with the quick-locking spanner 5 and disengaged from the button of the safety switch 80. Thus the safety switch 80 is switched off, and the control circuit 81 is in the off state.

Third Embodiment

Figure 17:
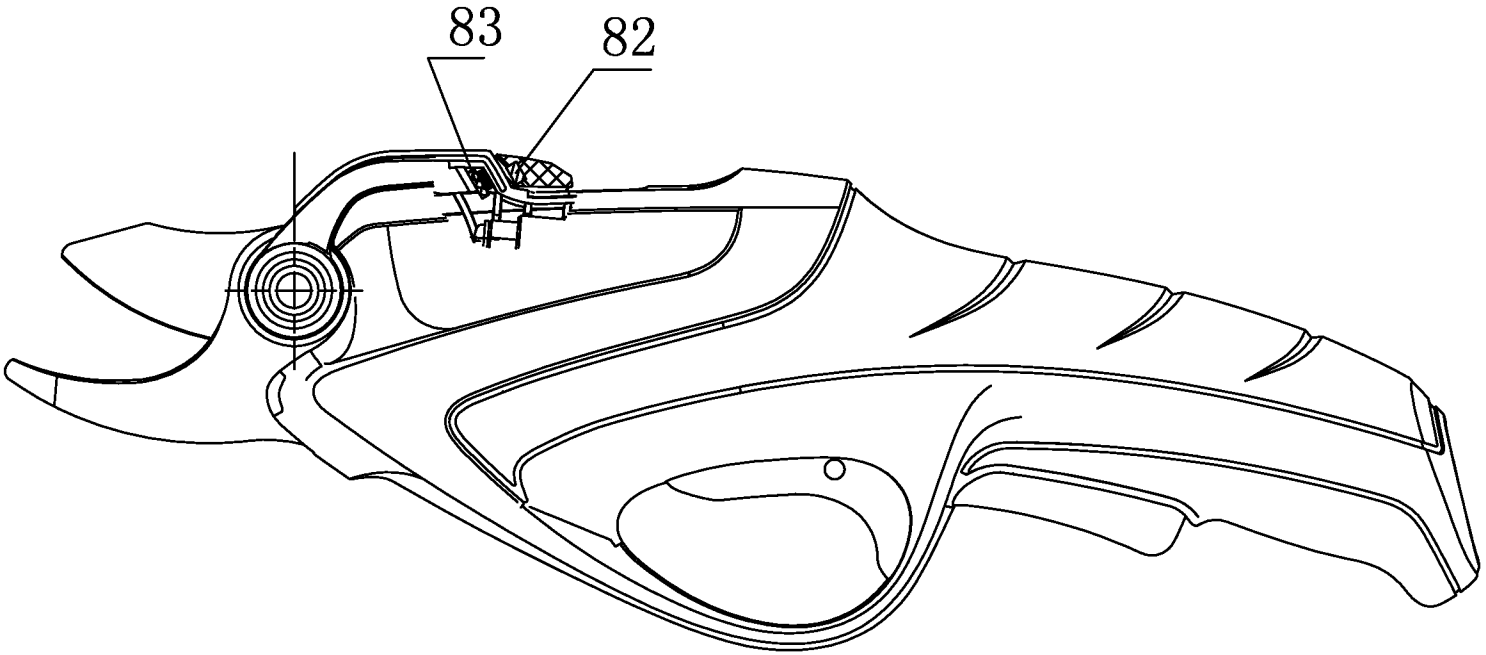
FIG. 17 is a schematic view of a third embodiment.
Figure 18:
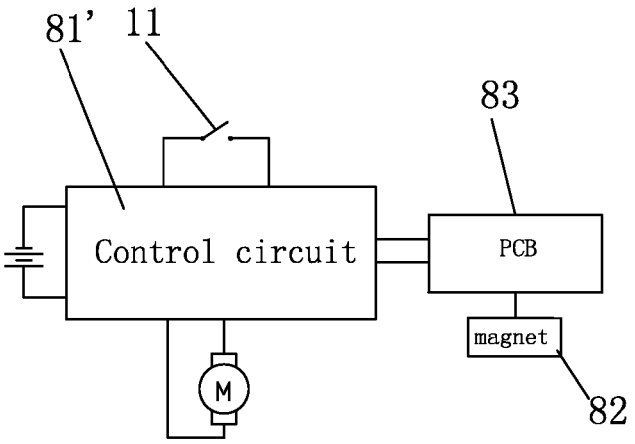
FIG. 18 is a circuit diagram of the third embodiment.
Figure 19:
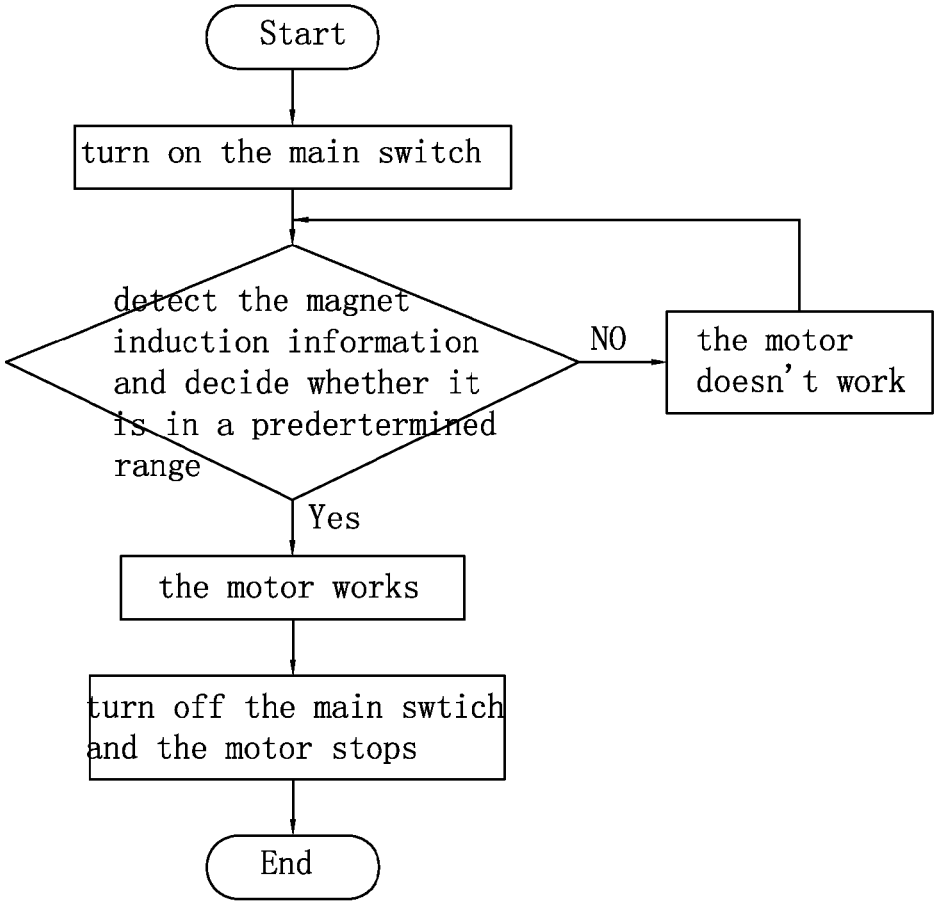
FIG. 19 is an operating flow chart of the third embodiment of the power tool.

Referring to FIGS. 17-19, the difference between the third embodiment and the aforesaid two embodiments is the safety device. In the third embodiment, the safety device ensures the replacement of the movable blade 21 quickly and safely in an electric manner. The safety device includes a trigger portion arranged on the quick-locking spanner 5 and a sensing portion for sensing the position of the trigger portion. The sensing portion is connected with the control circuit 81' so as to transmit the signal to the control circuit 81'. In the present embodiment, the trigger portion is a magnet 82 arranged on the control circuit 81', and the sensing portion is a PCB 83 with a magnetic induction sensor. The main switch 11 for controlling power on/off of the power pruner is also serially connected to the control circuit 81'.

In other embodiments, the trigger portion and the sensing portion for sensing the position of the trigger portion may be other devices which transmit optical signals or electrical signals.

The magnetic induction sensor on the PCB 83 can sense the distance between the magnet 82 and the magnetic induction sensor and provide this information to the control circuit 81'. Subsequently, the control circuit 81' connects or disconnects the circuit according to the information. When the circuit is closed, the electric pruner can be operated normally.

When the circuit is cut off, the movement of the blade is prevented.

Preferably, the magnet 82 is mounted on the quick-locking spanner 5. The PCB 83 with the magnetic induction sensor is fixed within the housing 1 of the electric pruner and near the magnet 82. When the quick-locking spanner 5 is in a locked state, the distance between the magnet 82 and the magnetic induction sensor is the shortest. At this time, the control circuit 81' closes the circuit such that the circuit is conducted. When the quick-locking spanner 5 is released, the distance between the magnet 82 and the magnetic induction sensor gradually increases. When the distance reaches into a predetermined range, the control circuit 81' will cut off the circuit according to the information provided by the magnetic induction sensor so that the motor can't be started.

Fourth Embodiment

In the fourth embodiment, the safety device is able to disconnect a transmission system of the power pruner. Even if the motor is powered to rotate, the rotation thereof can't be transmitted to the gears that drive the blade to move. Thus the movement of the blade is prevented.

The above contents are preferred embodiments of the present invention. It should be pointed out that, for one of ordinary skilled in the art, many modifications and transformations also can be carried out without departing from the technical principal of the present invention, which are also considered as falling within the protection scope of the present invention.

What is claimed is:

1. A power tool, comprising:

a housing;

a motor positioned in the housing;

a transmission mechanism positioned in the housing and driven by the motor;

a fixed blade fixed to the housing;

a movable blade rotatably connected to the fixed blade through a shaft, the movable blade being connected to the transmission mechanism such that the transmission mechanism is capable of driving the movable blade to perform a cutting motion;

a quick-locking device arranged on the housing for locking the movable blade, the quick-locking device comprising a quick-locking spanner which is switchable between a locking position where the movable blade is locked and connected with the transmission mechanism and a release position where the movable blade is released to be detachable from the transmission mechanism;

a control circuit for controlling the motor;

a main switch for powering on/off the motor, which is electrically connected to the control circuit; and a safety device capable of controlling the control circuit to be conducted or non-conducted in cooperate with the main switch, if the quick-locking spanner is in the release state, the control circuit is non-conducted result from the safety device, so that the movable blade is prevented from moving, if the quick-locking spanner is in the locking state, the control circuit is conducted when the main switch is turned on.

2. The power tool according to claim 1, wherein the safety device comprises a trigger portion and a connecting portion, the trigger portion is a boss arranged on the quick-locking spanner, the connecting portion comprises a pull rod being able to contact with the boss, a compression spring and an ejector rod, the compression spring is connected between the pull rod and the fixed blade, the ejector rod is connected to the pull rod and is capable of contacting with the main switch.

3. The power tool according to claim 1, wherein the safety device comprises a trigger portion and a safety switch serially connected to the control circuit, the safety switch can be triggered by the trigger portion.

4. The power tool according to claim 1, wherein the safety device comprises a trigger portion connected to the quick-locking spanner and a sensing portion electrically connected to the control circuit, the sensing portion is able to sense the position of the trigger portion.

5. The power tool according to claim 1, wherein the quick-locking device comprises a first engaging element and a second engaging element engaging with each other, the first engaging element comprises at least one first end surface boss having an inclined plane, and the second engaging element comprises at least one second end surface boss having an inclined plane, the first end surface boss and the second end surface boss engage with each other.

6. The power tool according to claim 1, wherein the shaft comprises a first mating portion and a second mating portion having an outer diameter smaller than that of the first mating portion

7. The power tool according to claim 6, wherein the movable blade has a groove which comprises a first groove portion and a second groove portion, the first groove portion being sized larger than the second groove portion, the second groove portion being sized larger than the outer diameter of the second mating portion.

8. The power tool according to claim 7, wherein the shaft is movable between a first position where the first mating portion is engaged with the first groove portion such that the movable blade is locked in position and a second position where the second mating portion is engaged with the first groove portion and the movable blade is released.

9. The power tool according to claim 8, wherein the shaft is a step-shaped bolt, and the second mating portion is flat and engaged with a square hole formed on the fixed blade.

10. A power tool, comprising:

a motor;

a replaceable blade driven by the motor;

a fixing device for clamping and securing the blade, which comprises a locking state wherein the blade is clamped and a release state wherein the blade can be replaced;

a control circuit for controlling the motor;

a main switch for powering on/off the motor, which is electrically connected to the control circuit; and a safety device for preventing the blade from moving when the fixing device is in the release state.

11. The power tool according to claim 10, wherein the fixing device comprises a quick-locking spanner which can be operated to switch the fixing device between the locking state and the release state.

12. The power tool according to claim 10, wherein the safety device comprises a connecting portion and a trigger portion arranged on the quick-locking spanner, the connecting portion is able to be triggered to move by the trigger portion, when the blade is fixed by the fixing device, the connecting portion is triggered to move to disengage from the main switch, when the fixing device is released to replace the blade, the connecting portion is moved to engage with the main switch so as to prevent the main switch from being turned on.

13. The power tool according to claim 12, wherein the trigger portion is a boss fixed on the quick-locking spanner and is capable of being moved together with the quick-locking spanner, the connecting portion comprises a pull rod capable of contacting with the boss, a compression spring connected to the pull rod and an ejector rod capable of contacting with the main switch, when the fixing device is in the release state, the ejector rod contacts with the main switch under the restoring force of the compression spring so as to prevent the main switch from being turned on.

14. The power tool according to claim 10, wherein the safety device comprises a trigger portion arranged on the fixing device and a safety switch serially connected to the control circuit, when the fixing device is in the locking state, the safety switch is triggered by the trigger portion, and when the fixing device is in the release state, the safety switch isn't triggered by the trigger portion so as to prevent the control circuit being conducted.

15. The power tool according to claim 10, wherein the safety device comprises a trigger portion arranged on the fixing device and a sensing portion electrically connected to the control circuit, the sensing portion is able to sense the position of the trigger portion.

16. The power tool according to claim 15, wherein the trigger portion is a magnet, and the sensing portion is a magnetic induction sensor.

17. The power tool according to claim 10, wherein the fixing device comprises a first engaging element and a second engaging element engaging with each other, the first engaging element comprises at least one first end surface boss having an inclined plane, and the second engaging element comprises at least one second end surface boss having an inclined plane, the first end surface boss and the second end surface boss engage with each other.

18. The power tool according to claim 10, wherein the blade has a groove which comprises a first groove portion and a second groove portion, the first groove portion being sized larger than the second groove portion.

19. The power tool according to claim 18, wherein the blade is rotatable mounted to the power tool through a shaft, the shaft comprises a first mating portion and a second mating portion having an outer diameter smaller than that of the first mating portion, the second groove portion being sized larger than the outer diameter of the second mating portion.

20. The power tool according to claim 19, wherein the shaft is movable between a first position where the first mating portion is engaged with the first groove portion such that the movable blade is locked in position and a second position where the second mating portion is engaged with the first groove portion and the movable blade is released.

* * * * *